US006427249B1

(12) United States Patent
Mattesky

(10) Patent No.: US 6,427,249 B1
(45) Date of Patent: Aug. 6, 2002

(54) HEAVY DUTY WORK GLOVE

(75) Inventor: Henry Mattesky, Roseland, NJ (US)

(73) Assignee: Magla World Wide, Ltd., Vega Baja, PR (US)

( * ) Notice: Subject to any disclaimer, the term of this patent is extended or adjusted under 35 U.S.C. 154(b) by 0 days.

(21) Appl. No.: 09/624,957

(22) Filed: Jul. 25, 2000

Related U.S. Application Data

(60) Provisional application No. 60/148,311, filed on Aug. 11, 1999.

(51) Int. Cl.[7] ..... A41D 19/00
(52) U.S. Cl. ..... 2/161.6
(58) Field of Search ..... 2/161.6, 161.8, 2/159, 163

(56) References Cited

U.S. PATENT DOCUMENTS 192,082 A * 6/1877 Peters
2,217,377 A * 10/1940 Moore
2,524,979 A * 10/1950 Kimbrell
3,597,765 A * 8/1971 Stanton
4,590,625 A * 5/1986 Keim
4,691,387 A * 9/1987 Lopez
5,504,942 A * 4/1996 Kuwahara
5,715,539 A * 2/1998 Benecki et al.
6,035,444 A * 3/2000 McGrew
6,055,669 A * 5/2000 Albert
6,185,747 B1 * 2/2001 Hughes

FOREIGN PATENT DOCUMENTS

FR 2567373 A1 * 1/1986
GB 1367488 A1 * 6/1964

* cited by examiner

*Primary Examiner*—Rodney M. Lindsey
(74) *Attorney, Agent, or Firm*—Selitto, Behr & Kim

(57) ABSTRACT

A heavy duty leather or canvas work glove preferably has suede leather palm and finger regions. The surface of these regions is covered with strips of suede cowhide leather having a thickness, shape and location so as to not affect glove flexibility and yet provide enhanced gripping and wear characteristics to the glove. Other embodiments are disclosed.

14 Claims, 6 Drawing Sheets

HEAVY DUTY WORK GLOVE

RELATED APLICATIONS

This application claims priority of commonly owned provisional application Ser. No. 60/148,311 filed Aug. 11, 1999.

DISCUSSION OF THE PRIOR ART

Heavy duty work gloves of leather or synthetic materials are well known. However, in the course of use, particularly in wet and/or greasy environments these gloves tend to slip on the work piece making further progress difficult or lead to unsafe working conditions. The present invention is a recognition of this problem and is directed to providing a solution thereto.

SUMMARY OF THE INVENTION

A work glove according to the present invention comprises a hand section comprising a sheet material palm portion layer having opposing first and second peripheral edges and a juxtaposed sheet material layer secured to the palm portion at the edges forming a first chamber for receiving a hand of a person. A plurality of finger sections each forming a finger chamber are for receiving a finger of the received hand, the finger sections comprising layers forming extensions of and secured to the palm portion layer and juxtaposed layer; the sheet materials including the finger extensions comprising material sufficiently flexible to permit the bending of fingers of the received hand. At least one friction grip enhancing element is secured to at least one of the palm portion sheet material and the finger section extension sheet material of the palm portion external the first chamber and the finger chamber.

In one aspect, there are a plurality of the at least one friction grip enhancing element. In a further aspect, the at least one friction grip enhancing element comprises a strip of material secured to the palm portion and finger extension thereof sheet material.

In a further aspect, the at least one friction grip enhancing element comprises a plurality of strips of material secured to the palm portion and finger extension thereof sheet material.

Preferably the elements are sewn or bonded to the sheet material and preferably, the strips and palm portion sheet material and the finger extensions of the palm portion material comprise suede leather.

Preferably, the palm portion layer, the juxtaposed layer, the finger extension layers and the at least one grip element comprise material selected from any one or more of the group consisting essentially of synthetic material, fabrics, cloth, felt, cotton, leather, suede, canvas, polyester, woven and nonwoven, rubber, latex, acrylic, fibrous material, knits, plastic coated material, elastomeric coated material, nylon, laminated sheet material and textured sheet material.

DESCRIPTION OF THE PREFERRED EMBODIMENTS

Figure 1:
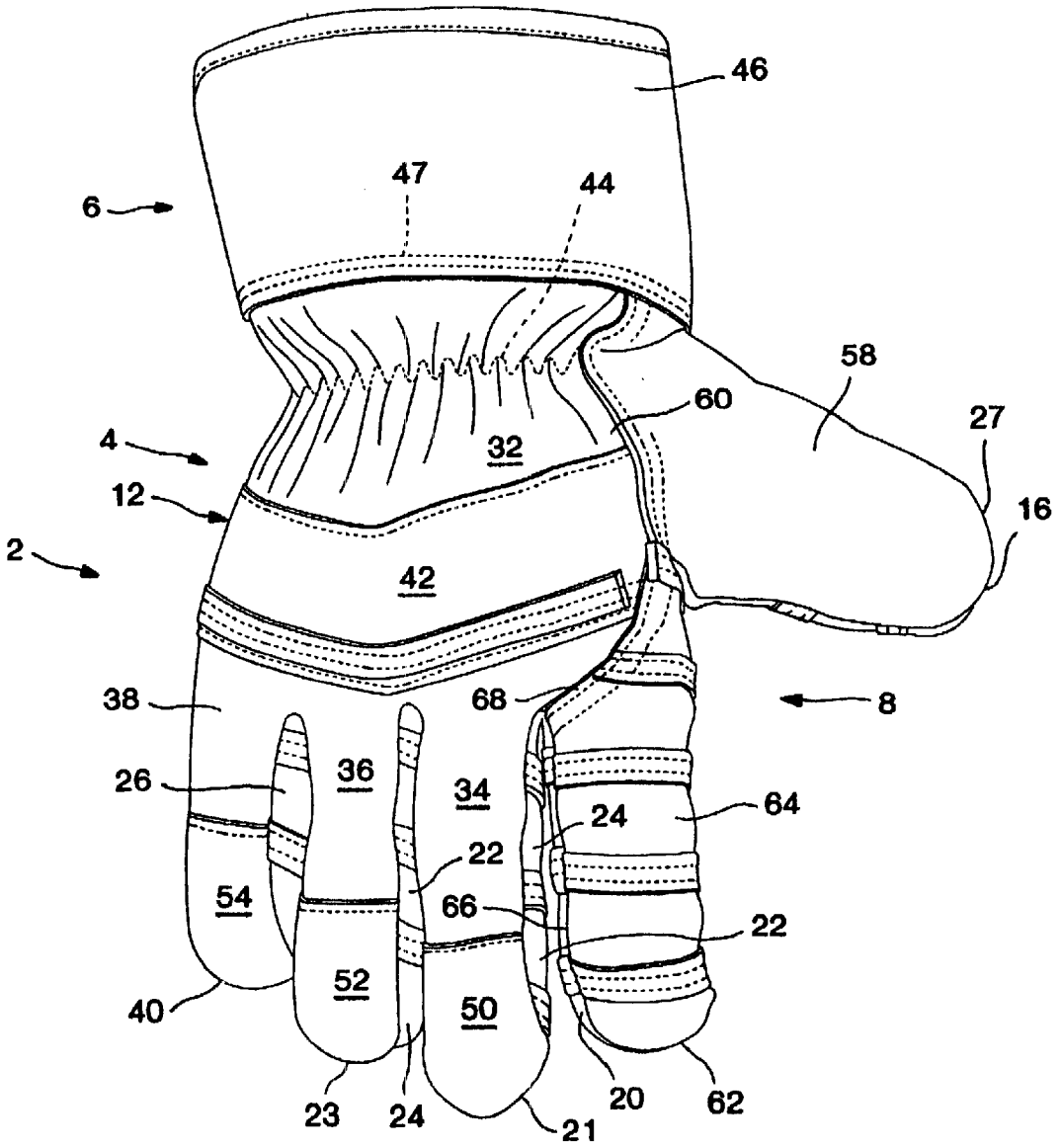
FIG. 1 is a top plan view of a work glove according to an embodiment of the present invention.

In FIGS. 1–4, glove 2 comprises a hand section 4, a wrist section 6 and a finger section 8. The hand section 4 comprises two juxtaposed layers 10 and 12. Palm layer 10 faces the palm of the received hand of a person and has opposing edges 14 and 16. Layer 12 is juxtaposed with layer 10 and is secured, e.g., sewn, to layer 10 at the edge 14.

Figure 2:
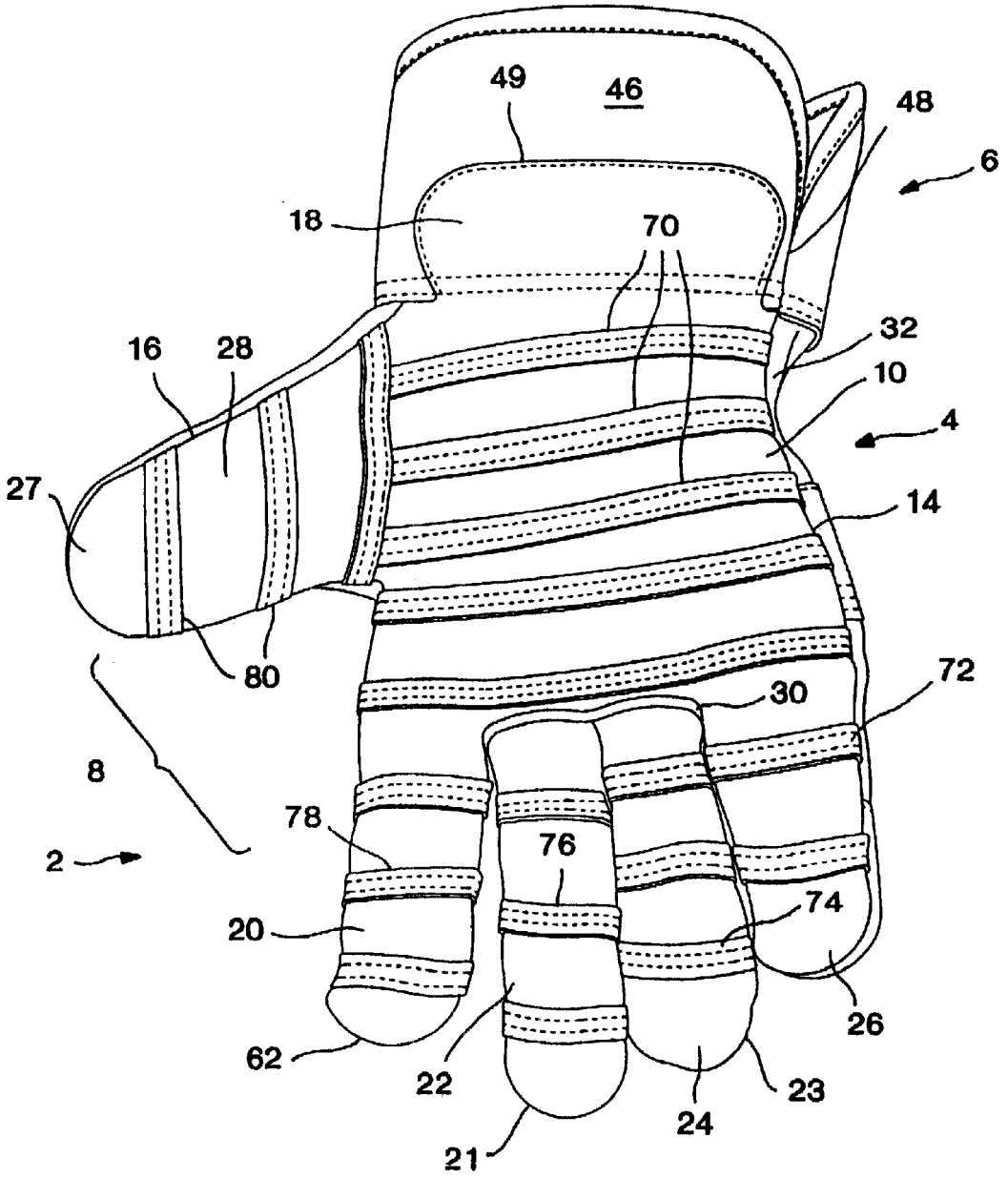
FIG. 2 is a bottom plan view of the glove of FIG. 1.
Figure 3:
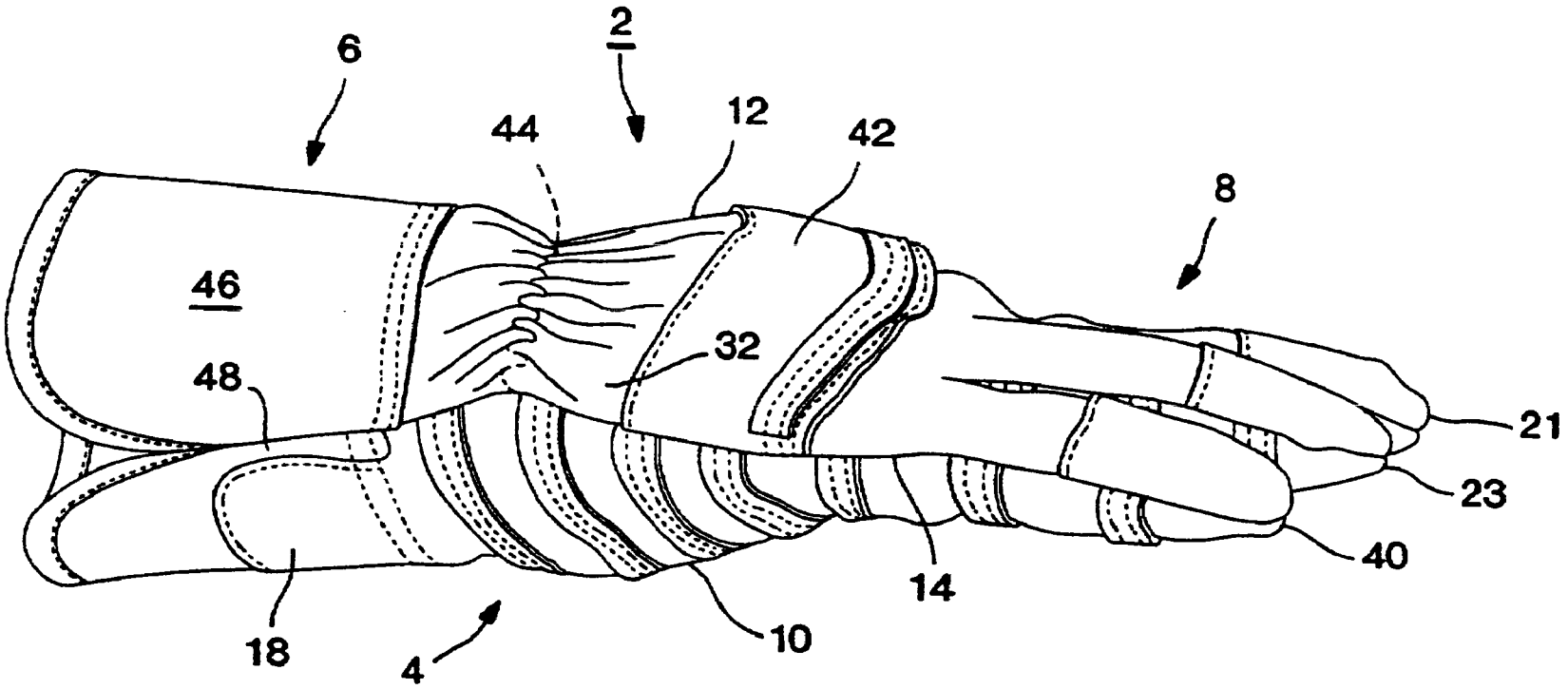
FIG. 3 is a side elevation view of the pinky finger side of the glove of FIGS. 1 and 2.
Figure 4:
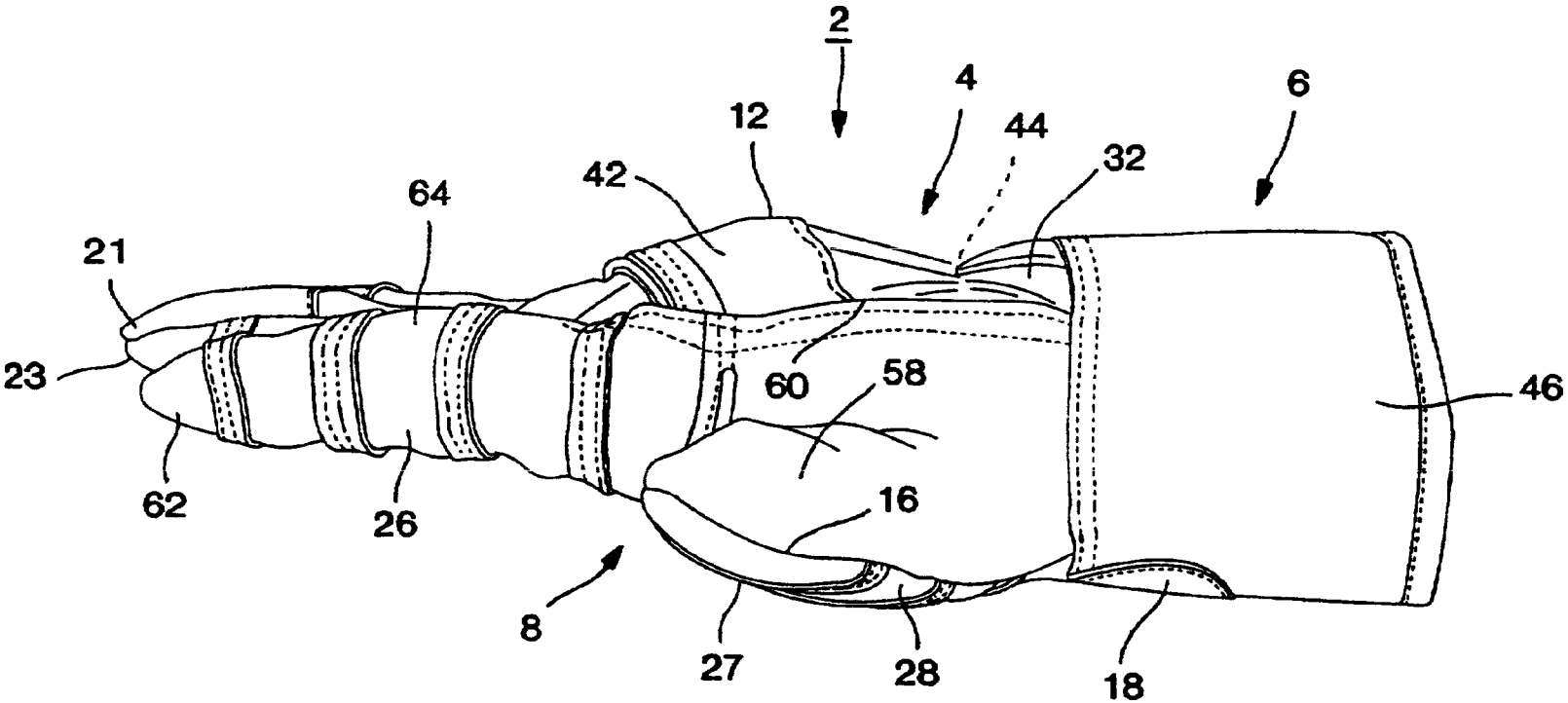
FIG. 4 is a side elevation view of the thumb side of the glove of FIGS. 1 and 2.

Layer 10, FIG. 2, includes a wrist extension 18 and is preferably suede leather cowhide. Layer 10 extends into the finger section 8 and has a plurality of finger extensions 20, 26 and 28 formed one piece therewith. Extension 28 is the thumb extension and the extensions 20 and 26 form the respective index and pinky finger extensions. The middle fingers 21 and 23 respectively comprise suede leather layer extensions 22 and 24 sewn to the layer 10 at seam 30. The middle finger extensions may in the alternative be one piece with layer 10. The thumb extension 28 layer is one piece with layer 10 or may in the alternative be a separate piece and sewn thereto according to a given implementation. Edge 16 is also the edge of the thumb 27 extension 28.

In FIG. 1, a layer 32 of woven canvas is sewn at edge 14 to palm layer 10 and has finger extension portions 34, 36, 38 juxtaposed with the respective fingers 21, 23 and 40. As strip of suede leather 42 is sewn to the top of layer 32. An elastic band 44 is used to gather the layer 32 to form a resilient chamber between the layers 10 and 32. A wrist layer 46 of canvas is sewn to the layer 32 at seam 47, at seam 48 to itself and at seam 49 to palm layer 10 extension 18.

Suede leather finger tip portions 50, 52 and 54 are sewn to extension portions 34, 36 and 38 respectively and are juxtaposed with the finger extensions of layer 10 and sewn thereto at appropriate seams. A suede leather thumb extension 58 is sewn to layer 32 at seam 60 juxtaposed with the thumb extension 28 and sewn to layer 10 thumb extension 28 at edge 16.

The index finger 62 has a suede leather extension layer portion 64 of layer 10 sewn to the underlying finger extension 20 of layer 10 at seam 66 and to the canvas layer 32 at seam 68.

While the glove described above is described as preferably comprising suede leather and canvas it may comprise any other sheet material such as synthetic material such as rayon and so on, cloth, felt, cotton, leather, suede material of any composition, polyester, woven and non-woven material, rubber such as latex, acrylic, fibrous material of any fiber composition plant based or non-plant based such as metal fibers, glass fibers, knits, plastic coated material, elastomeric coated material, nylon, laminated sheet material and textured sheet material. While sewn seams are preferred for the materials described, these and other types of materials may be joined by any known technique including bonding with adhesives, heat sealing and so on.

In FIG. 2, a plurality of strips 70, 72, 74, 76, 78 and 80 of cowhide suede leather are sewn to the face of the palm layer 10 and to the finger extensions 20, 22, 24, 26 of layer 10 and to the thumb 27 extension 28. These strips preferably are about 0.048 inches thick and are about 5/16 inch wide. The strips 78 surround the index finger 62 and radially surround a portion of the remaining fingers. Otherwise the remaining strips are all facing in about the same direction from the palm layer 10 and its extensions in the palm and finger regions of the glove. These strips may be made of other materials as noted above in the alternative.

The strips provide improved life to the glove and, more importantly, provide enhanced gripping friction engagement during use of the glove without loss of flexibility of the glove. The location of the strips is not critical but it is preferred that they not be located at the finger joints to enhance flexibility of the fingers. Tests have shown that gloves with the leather strips as described lasted about 50% longer than comparable gloves without the strips. Tests showed that the gloves with the strips exhibited a better grip and were tougher than gloves without the strips.

Synthetic materials alone or in combination with natural materials such as cotton or leather as the glove body and/or strips may be used. 100% cotton canvas gloves were provided with ¼ inch wide strips of a grip fabric under the trademark Slip-Not manufactured by Eastex Co. of Boston, Mass. comprising a PVC coating on a polyester woven substrate of 0.7 mm thickness. The strips provided increased gripping characteristics while the glove remained comfortably flexible. The strips provided improved gripping characteristics when compared to the same cotton glove with the Slip-Not material covering the entire palm and finger area of the glove without the strips. A 100% acrylic fiber string knit glove manufactured by the Perfect Fit Glove Company /Buffalo, N.Y. was provided with 0.020 inch thick rubber strips 0.5 inches wide. The glove exhibited an improved gripping and wear characteristic.

The strips can be attached by any means such as sewing, lamination, fusing, or other bonding using adhesives and so on or can be formed on the gloves by molding or printing. The thicker the strips the better the gripping action. The strips do not have to be contiguous, but can comprise a series of dots, dashes, triangles, circles or any geometric shape, regular or irregular. The dots or bumps of material may be arranged in a pattern simulating strips across the glove palm and finger areas without substantial loss of flexibility of the glove when the hand is opened and closed. In the alternative the strips may run across the palm and finger areas of the glove at any angle to the length dimension of the glove from the wrist to finger sections. Angles of 60 degrees or more to the length dimension may decrease flexibility when elongated strips are used. Angles of about 30 degrees or less is preferred to minimize loss of flexibility.

Figure 5:
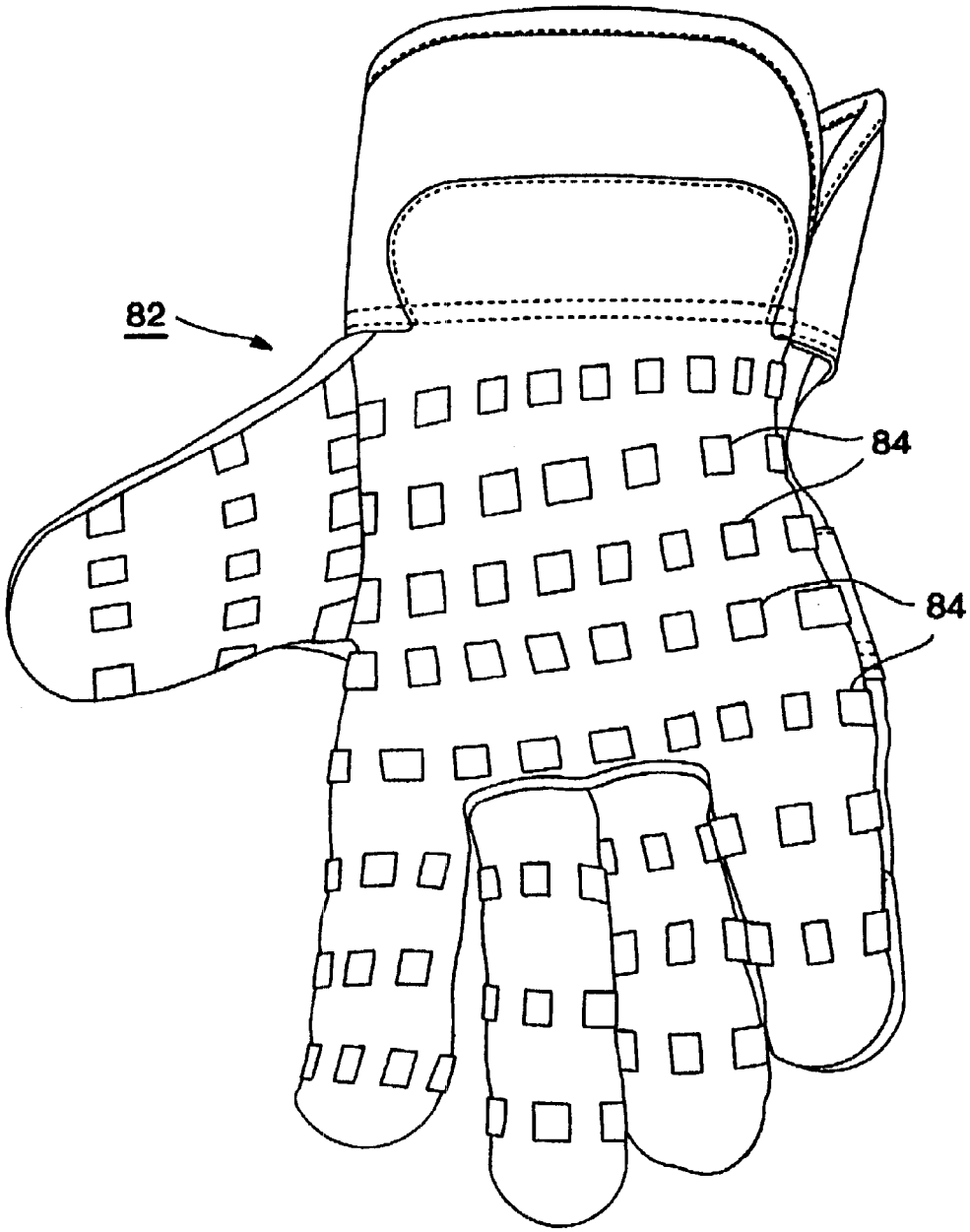
FIG. 5 is a bottom plan view of a glove according to a second embodiment of the present invention.
Figure 6:
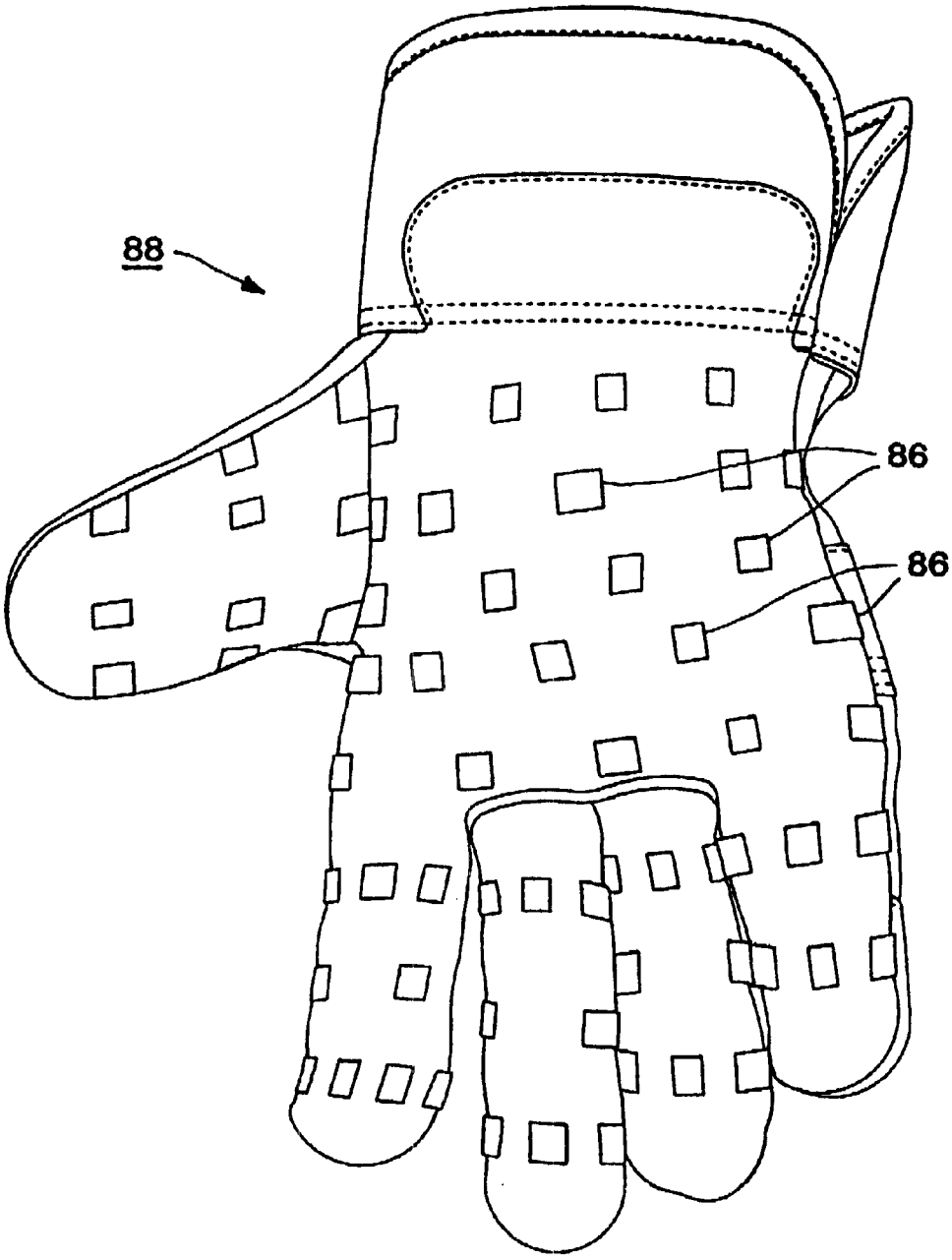
FIG. 6 is a bottom plan view of a glove according to a second embodiment of the present invention.

In FIG. 5, glove 82 is of the same construction as glove 2 of FIG. 1 except the strips 70, 72, 74, 76, 78 and 80 are replaced with leather cowhide suede projections 84. The projections 84 while shown square may be rectangular or any other shape. The thickness is as described above and may be about ⅝ inch square. In the alternative, they may have widths of about ⅛–⅝ inch and lengths of any dimension according to a given implementation. The projections are arranged in linear arrays across the glove palm and finger areas but this is not critical, as long as the pattern allows for Linear areas where projections are absent so as not to impair flexibility In FIG. 6, a glove 88 the same glove as glove 82 is covered with projections 86 in more random locations over the face of the palm and finger regions. The material and thickness is as described above in the other embodiments.

It will occur to one of ordinary skill that various modifications may be made to the disclosed embodiments without departing from the scope of the invention as defined in the appended claims. The description given herein is given by way of illustration and not limitation.

What is claimed is:

1. A work glove comprising;

a hand section comprising a palm portion of sheet material having opposing first and second peripheral edges and a juxtaposed layer of sheet material coupled to the palm portion at the edges forming a first chamber for receiving a hand of a person;

a plurality of finger sections each forming a finger chamber for receiving a finger of the received hand, the finger sections comprising layers of sheet material forming finger extensions of and secured to the palm portion and the juxtaposed layer, respectively; the sheet material of the finger extensions comprising material sufficiently flexible to permit the bending of fingers of the received hand; and a plurality of friction grip enhancing elements secured to the palm portion and at least one finger section external the first chamber and the finger chamber of the at least one finger section, each of said plurality of friction grip enhancing elements being in the form of an elongated strip with an elongated dimension and a narrow dimension and being secured to the glove with the elongated dimension disposed substantially perpendicularly to the direction of extension of the finger sections.

2. The glove of claim 1 wherein at least one of said friction grip enhancing elements completely encircles at least one of said finger sections.

3. The glove of claim 2 wherein at least one of the plurality of friction grip enhancing elements extends across the palm portion from the first peripheral edge to the second peripheral edge.

4. The glove of claim 3 wherein a plurality of the friction grip enhancing elements extend across the palm portion.

5. The glove of claim 4 wherein the friction grip enhancing elements are sewn to the glove.

6. The glove of claim 5 wherein the friction grip enhancing elements, the palm portion and the finger extensions of the palm portion are suede leather.

7. The glove of claim 1 wherein the palm portion and the plurality of friction grip enhancing elements are leather.

8. The glove of claim 1 wherein the plurality of friction grip enhancing elements are bonded to the palm portion and finger extensions thereof.

9. The glove of claim 1 wherein the plurality of friction grip enhancing elements are sewn to the palm portion and finger extensions thereof.

10. The glove of claim 1 wherein the palm portion, the juxtaposed layer, the finger extensions and the plurality of friction grip enhancing elements are material selected from any one or more of the group consisting essentially of synthetic material, fabrics, cloth, felt, cotton, leather, suede, canvas, polyester, woven and nonwoven, rubber, latex, acrylic, fibrous material, knits, plastic coated material, elastomeric coated material, nylon, laminated sheet material and textured sheet material.

11. The glove of claim 1 wherein the independent elements are convex protrusions.

12. The glove of claim 10 wherein at least one of the plurality of friction grip enhancing elements is discontinuous, having a plurality of independent elements arranged in a linear array.

13. The glove of claim 12 wherein a plurality of the friction enhancing elements are discontinuous.

14. The glove of claim 1 wherein said friction grip enhancing elements have opposing edges extending along the elongated dimension and are secured to the glove intermediate said opposing edges.

* * * * *